US011361695B2

(12) United States Patent
Zhu et al.

(10) Patent No.: US 11,361,695 B2
(45) Date of Patent: Jun. 14, 2022

(54) GATE-DRIVER-ON-ARRAY TYPE DISPLAY PANEL

(71) Applicant: SHENZHEN CHINA STAR OPTOELECTRONICS SEMICONDUCTOR DISPLAY TECHNOLOGY CO., LTD., Guangdong (CN)

(72) Inventors: Jing Zhu, Guangdong (CN); Wei Shao, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 266 days.

(21) Appl. No.: 16/764,747

(22) PCT Filed: Apr. 14, 2020

(86) PCT No.: PCT/CN2020/084615
§ 371 (c)(1),
(2) Date: May 15, 2020

(87) PCT Pub. No.: WO2021/196272
PCT Pub. Date: Oct. 7, 2021

(65) Prior Publication Data

US 2022/0114933 A1 Apr. 14, 2022

(30) Foreign Application Priority Data

Mar. 31, 2020 (CN) ..... 202010241602.1

(51) Int. Cl.
*G09G 3/20* (2006.01)

(52) U.S. Cl.
CPC ..... *G09G 3/20* (2013.01); *G09G 2300/0408* (2013.01); *G09G 2310/0267* (2013.01); *G09G 2310/0275* (2013.01)

(58) Field of Classification Search
CPC ..... G09G 3/20; G09G 2300/0408; G09G 2310/0267; G09G 2310/0275
See application file for complete search history.

(56) References Cited

U.S. PATENT DOCUMENTS

| | | | | |
|---|---|---|---|---|
| 9,858,880 | B2 * | 1/2018 | Dai | G09G 3/3266 |
| 2015/0185520 | A1 * | 7/2015 | Xu | G09G 3/3655 327/108 |
| 2015/0221272 | A1 * | 8/2015 | Xu | G09G 3/3659 345/92 |

(Continued)

FOREIGN PATENT DOCUMENTS

| | | | |
|---|---|---|---|
| CN | 104537993 | A | 4/2015 |
| CN | 104793417 | A | 7/2015 |

(Continued)

*Primary Examiner* — Gerald Johnson

(57) ABSTRACT

A gate-driver-on-array type display panel having a display area includes a plurality of pixel units and a GOA circuit, wherein the pixel units and the GOA circuit are disposed in the display area. The GOA unit set and the GOA trace set are respectively disposed in the pixel units that are in two adjacent rows, and the GOA trace set is electrically connected to two ends of the GOA unit set through a plurality of first signal connecting traces.

18 Claims, 2 Drawing Sheets

(56) References Cited

U.S. PATENT DOCUMENTS

| | | | | |
|---|---|---|---|---|
| 2016/0267831 | A1 | 9/2016 | Seo et al. | |
| 2016/0307938 | A1 | 10/2016 | Jin | |
| 2017/0117341 | A1 | 4/2017 | Chen et al. | |
| 2017/0345373 | A1 | 11/2017 | Kang et al. | |
| 2018/0211876 | A1* | 7/2018 | Li | H01L 27/12 |
| 2019/0266933 | A1* | 8/2019 | Lee | G09G 3/2092 |
| 2019/0325797 | A1 | 10/2019 | Kanda et al. | |
| 2019/0386001 | A1* | 12/2019 | Hong | H01L 27/0288 |
| 2020/0111859 | A1 | 4/2020 | Ko et al. | |
| 2020/0402475 | A1 | 12/2020 | Li | |

FOREIGN PATENT DOCUMENTS

| | | | |
|---|---|---|---|
| CN | 104934005 | A | 9/2015 |
| CN | 105139806 | A | 12/2015 |
| CN | 106098698 | A | 11/2016 |
| CN | 106898324 | A | 6/2017 |
| CN | 107045850 | A | 8/2017 |
| CN | 109192751 | A | 1/2019 |
| CN | 109994069 | A | 7/2019 |
| CN | 110599898 | A | 12/2019 |
| JP | 2019191235 | A | 10/2019 |

* cited by examiner

GATE-DRIVER-ON-ARRAY TYPE DISPLAY PANEL

FIELD OF INVENTION

The present application relates to the field of display technologies, and more particularly, to a gate-driver-on-array type display panel.

BACKGROUND OF INVENTION

Gate driver on array (GOA) technology is a technology in which gate driver circuits (gate driver ICs) are directly fabricated on an array substrate instead of a driver chip made of an external silicon chip. The GOA circuit can directly be disposed around the panel to reduce the fabricating process. That is beneficial to realize a narrow border design on a side where the GOA circuit is provided for a display screen, and also can reduce the production cost, so that the GOA is widely used and studied.

In response to the needs of consumers, a display with the characteristics, such as a large size, high resolution, and a super narrow border (SNB) design, has become a market trend. In addition, the narrow border design is necessary for a spliced display screen. However, the GOA layout space increases with the increase of the resolution and the reduction of the pixel size. For large-size and high-resolution display screens, the resistance-capacitance loading (RC loading) during signal transmission is great, such that a wide GOA bus line (busline) design is necessary, which results in a great width of the display screen border. Currently, the super narrow border design is realized by GOA In AA technology (in which a GOA disposed in display area). However, the pixel size reduces with the increases of the resolution of the display device. For example, the pixel size of a display screen with 8K resolution (7680 RGB & 2160 resolution) is very small. Disposing the GOA circuit in the display area results in the decrease of the aperture ratio (AR %) of the display screen and the seriously insufficient transmission ratio of the display screen. Therefore, the display effect of the display is further affected.

In summary, for the existing gate-driver-on-array type display panel, when the GOA circuit is disposed in the display area, the aperture ratio is reduced and the transmission ratio is seriously insufficient, and, thereby the display effect of the display is further affected.

Technical Problems

For the existing gate-driver-on-array type display panel, when the GOA circuit is disposed in the display area, the aperture ratio is reduced and the transmission ratio is seriously insufficient, and thereby the display effect of the display is further affected.

SUMMARY OF INVENTION

Technical Solutions

The embodiment of present application provides a gate-driver-on-array type display panel, which can effectively improve the aperture ratio of the pixel while realizing a super narrow border design, to solve the technical problem of the existing gate-driver-on-array type display panel, i.e. when the GOA circuit is disposed in the display area, the aperture ratio is reduced and the transmission ratio is seriously insufficient, and thereby the display effect of the display is further affected.

In a first aspect, a gate-driver-on-array type display panel is provided by an embodiment of the present application. The gate-driver-on-array type display panel has a display area, and the gate-driver-on-array type display panel includes a plurality of pixel units and a GOA circuit.

The pixel units are disposed in an array in the display area, and the GOA circuit is disposed in the display area. The GOA circuit includes a GOA unit set and a GOA trace set, the GOA unit set and the GOA trace set are respectively disposed in the pixel units that are in two adjacent rows, and the GOA trace set is electrically connected to two ends of the GOA unit set through a plurality of first signal connecting traces, the GOA circuit disposed along an extending direction of a long edge of the gate-driver-on-array type display panel.

In the gate-driver-on-array type display panel provided by the embodiment of the present application, the GOA unit set includes a plurality of cascaded GOA units.

In the gate-driver-on-array type display panel provided by the embodiment of the present application, each one of the GOA units includes a plurality of thin film transistors and a plurality of first internal connecting traces, and each of the first internal connecting traces is electrically connected to the respective thin film transistor.

In the gate-driver-on-array type display panel provided by the embodiment of the present application, the gate-driver-on-array type display pane further includes a plurality of scan lines and a plurality of data lines, wherein the scan lines are electrically connected to the thin film transistors, and an arrangement direction of the data lines is perpendicular to an arrangement direction of the scan lines.

In the gate-driver-on-array type display panel provided by the embodiment of the present application, a side of each one of the data lines is correspondingly provided with one of the first signal connecting traces, and an arrangement direction of the first signal connecting traces is parallel to the arrangement direction of the data lines.

In the gate-driver-on-array type display panel provided by the embodiment of the present application, the first internal connecting trace goes across the data line and electrically connects the GOA unit set and the first signal connecting trace.

In the gate-driver-on-array type display panel provided by the embodiment of the present application, the scan lines and the first internal connecting traces are formed in a first metal layer, and the data lines and the first signal connecting traces are formed in a second metal layer.

In the gate-driver-on-array type display panel provided by the embodiment of the present application, the material of the first metal layer is any one of Ti, Mo, Ta, W, and Nb, and the material of the second metal layer is any one of Cu, Al, Ag, and Au.

In the gate-driver-on-array type display panel provided by the embodiment of the present application, the GOA trace set includes a GOA bus line and a common line.

In the gate-driver-on-array type display panel provided by the embodiment of the present application, the GOA circuit is disposed along an extending direction of a long edge of the gate-driver-on-array type display panel.

In a second aspect, a gate-driver-on-array type display panel is provided by an embodiment of the present application. The gate-driver-on-array type display panel has a display area, and the gate-driver-on-array type display panel includes a plurality of pixel units and a GOA circuit.

The pixel units are disposed in an array in the display area, and the GOA circuit is disposed in the display area. The GOA circuit includes a GOA unit set and a GOA trace set, the GOA unit set and the GOA trace set are respectively disposed in the pixel units that are in two adjacent rows, and the GOA trace set is electrically connected to two ends of the GOA unit set through a plurality of first signal connecting traces.

In the gate-driver-on-array type display panel provided by the embodiment of the present application, the GOA unit set includes a plurality of cascaded GOA units.

In the gate-driver-on-array type display panel provided by the embodiment of the present application, each one of the GOA units includes a plurality of thin film transistors and a plurality of first internal connecting traces, and each of the first internal connecting traces is electrically connected to the respective thin film transistor.

In the gate-driver-on-array type display panel provided by the embodiment of the present application, the gate-driver-on-array type display pane further includes a plurality of scan lines and a plurality of data lines, wherein the scan lines are electrically connected to the thin film transistors, and an arrangement direction of the data lines is perpendicular to an arrangement direction of the scan lines.

In the gate-driver-on-array type display panel provided by the embodiment of the present application, a side of each one of the data lines is correspondingly provided with one of the first signal connecting traces, and an arrangement direction of the first signal connecting traces is parallel to the arrangement direction of the data lines.

In the gate-driver-on-array type display panel provided by the embodiment of the present application, the first internal connecting trace goes across the data line and electrically connects the GOA unit set and the first signal connecting trace.

In the gate-driver-on-array type display panel provided by the embodiment of the present application, the scan lines and the first internal connecting traces are formed in a first metal layer, and the data lines and the first signal connecting traces are formed in a second metal layer.

In the gate-driver-on-array type display panel provided by the embodiment of the present application, the material of the first metal layer is any one of Ti, Mo, Ta, W, and Nb, and the material of the second metal layer is any one of Cu, Al, Ag, and Au.

In the gate-driver-on-array type display panel provided by the embodiment of the present application, the GOA trace set includes a GOA bus line and a common line.

Beneficial Effect

Compared with the existing technology, in the gate-driver-on-array type display panel provided by the embodiment of the present application, when the GOA circuit is disposed in the display area, the GOA unit set and the GOA trace set are respectively disposed in the pixel units that are in two adjacent rows, and the GOA unit set is electrically connected to the GOA trace set through the signal connecting traces. Therefore, the present application effectively can reduce the actual space height of the GOA circuit, further improve the aperture ratio of the pixels, and yet further improve the display effect of the gate-driver-on-array type display panel, while realizing the super narrow border design.

DETAILED DESCRIPTION OF PREFERRED EMBODIMENTS

The embodiment of the present application forces on the technical problem of the existing gate-driver-on-array type display panel, which is that when the GOA circuit is disposed in the display area, the aperture ratio is reduced and the transmission ratio is seriously insufficient, thereby the display effect of the display is further affected. The embodiment of the present application can solve this defect.

The gate-driver-on-array type display panel is a display panel in which the gate driver circuit (GOA circuit) is directly fabricated on an array substrate instead of a driver chip made of an external silicon chip. The gate-driver-on-array type display panel has a display area and a border area, wherein the display area is an active area of a display panel used for displaying images, and the border area surrounds the outer periphery of the display area as a layout space for circuits and related traces.

Figure 1:
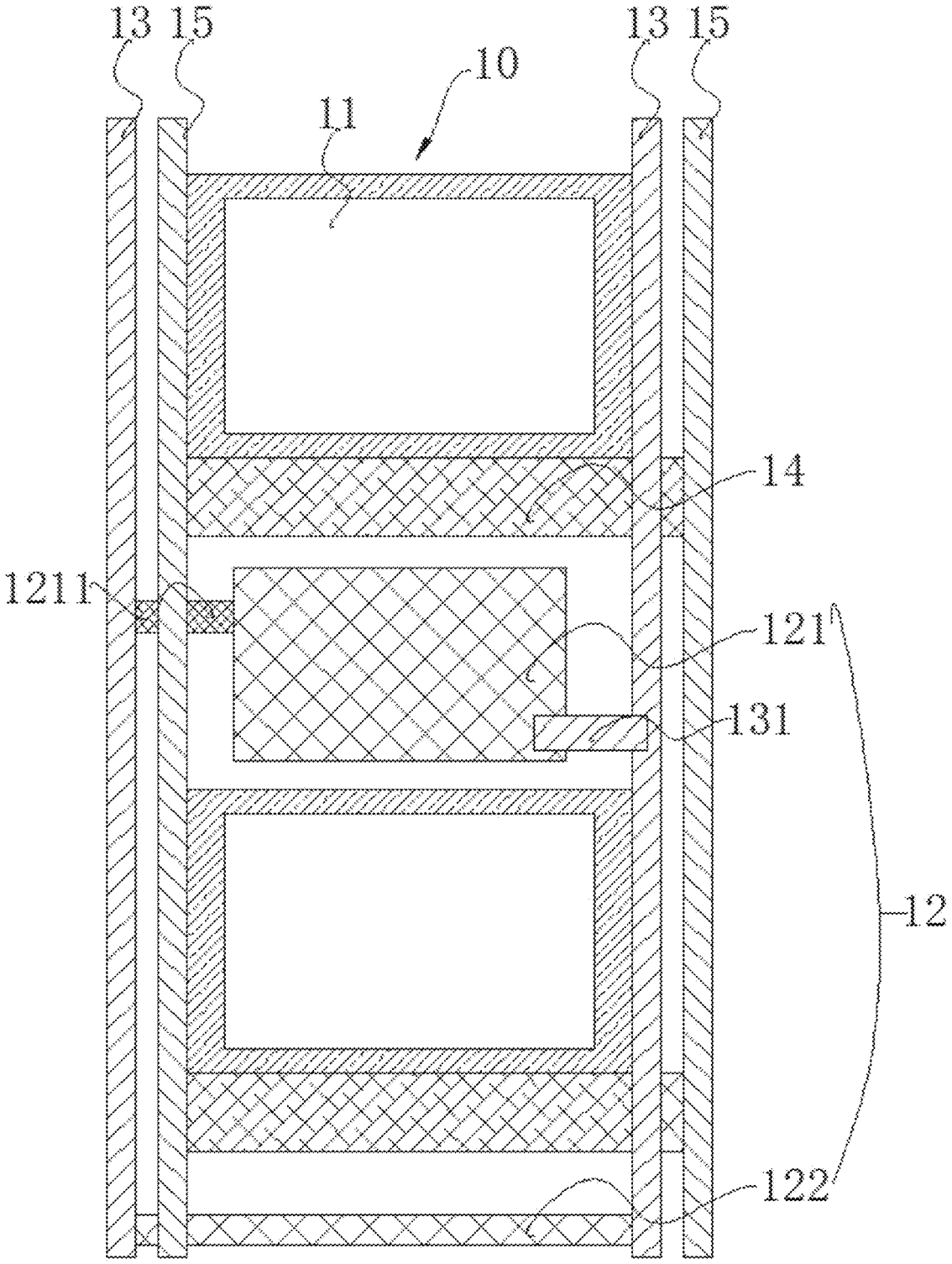
FIG. 1 is a schematic structure diagram of a gate-driver-on-array type display panel located in the display area, provided by an embodiment of the present application.

As shown in FIG. 1, FIG. 1 is a schematic structure diagram of a gate-driver-on-array type display panel located in the display area, provided by an embodiment of the present application. In which, a plurality of pixel units 11 and GOA circuit 12 are disposed in the display area 10. The pixel units 11 are disposed in an array in the display area 10. The GOA circuit 12 includes a GOA unit set 121 and a GOA trace set 122, the GOA unit set 121 and the GOA trace set 122 are respectively disposed in the pixel units 11 that are in two adjacent rows, and the GOA trace set is electrically connected to two ends of the GOA unit set 121 through a plurality of first signal connecting traces 13.

Specifically, the GOA unit set 121 includes a plurality of cascaded GOA units. That is, each GOA unit set 23 includes a plurality of GOA units, such as GOA (1), GOA (2), GOA (M−1), GOA (M), etc., where M is a positive integer greater than 1. The GOA unit set is connected to the GOA bus line (busline) through a signal lead led out of the GOA unit set. The driving signal of the gate-driver-on-array type display panel is input from each signal input terminal, and is transmitted to the GOA unit set 121 connected thereto through the GOA bus line (busline), such that the driving signal arrives a clock signal input terminal of each GOA unit to realize a signal drive to each GOA unit.

Further, each one of the GOA units 121 includes a plurality of thin film transistors (TFT) and a plurality of first internal connecting traces 1211, and each of the first internal connecting traces 1211 is electrically connected to the respective thin film transistor.

Specifically, the gate-driver-on-array type display panel further includes a plurality of scan lines 14 (Gate) and a plurality of data lines 15 (Data), wherein the scan lines 14 (Gate) are electrically connected to the thin film transistors (TFT), and an arrangement direction of the data lines 15 (Data) is perpendicular to an arrangement direction of the scan lines 14 (Gate).

A side of each one of the data lines 15 (Data) is correspondingly provided with one of the first signal connecting traces 13, and an arrangement direction of the first signal connecting traces 13 is parallel to the arrangement direction of the data lines 15 (Data). The first internal connecting trace 1211 goes across the data line 15 (Data) and electrically connects the GOA unit set 121 with the first signal connecting trace 13 on one side.

Specifically, the first signal connecting trace 13 further includes a second internal connecting trace 131, and the second internal connecting trace 131 electrically connects the GOA unit set 121 with the first signal connecting trace 13 on the opposite side.

Specifically, the scan lines 14 (Gate) and the first internal connecting traces 1211 are formed in a first metal layer (M1), and the data lines 15 (Data) and the first signal connecting traces 13 are formed in a second metal layer (M2).

Furthermore, the material of the first metal layer (M1) is any one of Ti, Mo, Ta, W, and Nb, and the material of the second metal layer (M2) is any one of Cu, Al, Ag, and Au.

Specifically, the GOA trace set 122 includes a GOA bus line (busline) and a common line (com).

Figure 2:
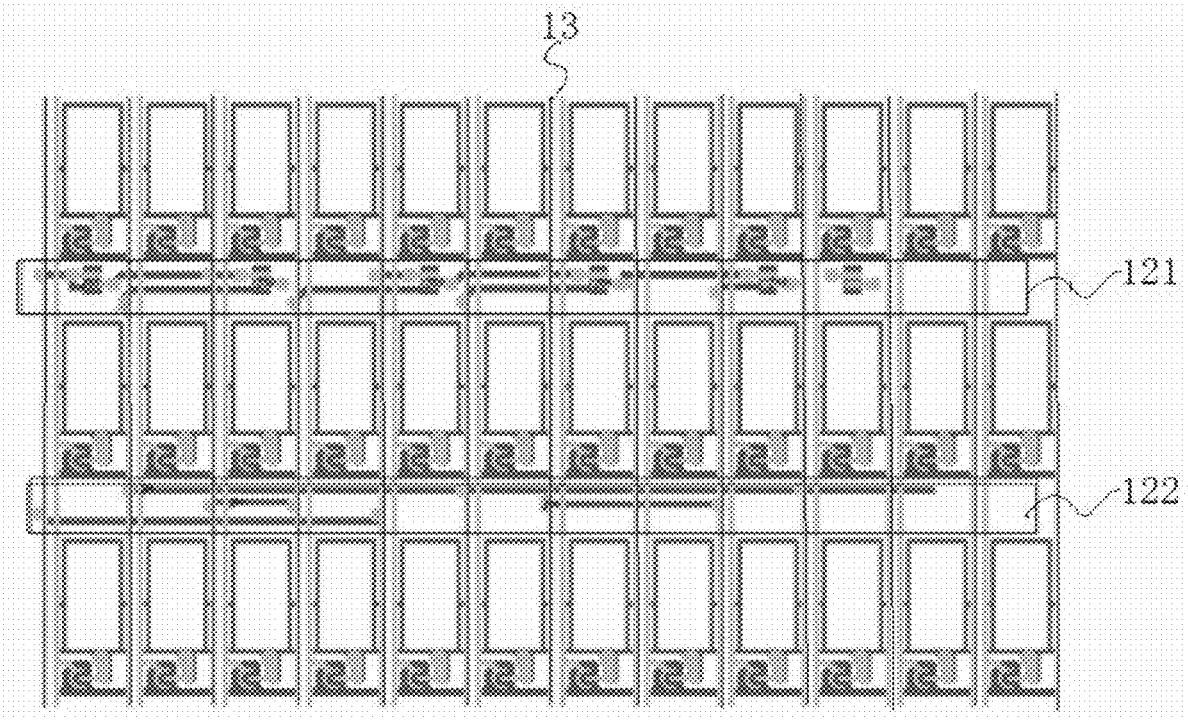
FIG. 2 is a layout design diagram of a GOA circuit in the gate-driver-on-array type display pane provided by the embodiment of the present application.

As shown in FIG. 2, FIG. 2 is a layout design diagram of a GOA circuit in the gate-driver-on-array type display pane provided by the embodiment of the present application. The shape of the gate-driver-on-array type display panel is generally rectangular, and the gate-driver-on-array type display panel includes two opposite long edges and two opposite short edges, where the long edges are adjacent to the short edges. The GOA circuit 12 is disposed along an extending direction of the long edge of the gate-driver-on-array type display panel. The GOA unit set 121 and the GOA trace set 122 are respectively disposed in the pixel units that are in two adjacent rows, and the GOA unit set 121 and the GOA trace set 12 electrically are connected to each other through the first signal connecting traces 13. This can effectively an actual space height H of the GOA circuit 12.

Specifically, the GOA unit set 121 is disposed along the extending direction of the long edge of the gate-driver-on-array type display panel, and the GOA trace set 122 is disposed in parallel with the GOA unit set 121.

The specific implementation of the above operations can refer to the previous embodiments, and will not be repeated here.

In summary, in the gate-driver-on-array type display panel provided by the embodiment of the present application, when the GOA circuit is disposed in the display area, the GOA unit set and the GOA trace set are respectively disposed in the pixel units that are in two adjacent rows, and the GOA unit set is electrically connected to the GOA trace set through the signal connecting traces. Therefore, the present application effectively can reduce the actual space height of the GOA circuit, further improve the aperture ratio of the pixels, and yet further improve the display effect of the gate-driver-on-array type display panel, while realizing the super narrow border design.

In view of the above, although the present invention has been disclosed by way of preferred embodiments, the above preferred embodiments are not intended to limit the present invention, and one of ordinary skill in the art, without departing from the spirit and scope of the invention, the scope of protection of the present invention is defined by the scope of the claims.

What is claimed is:

1. A gate-driver-on-array type display panel having a display area, comprising:

a plurality of pixel units disposed in an array in the display area; and a GOA circuit disposed in the display area;

wherein the GOA circuit comprises a GOA unit set and a GOA trace set, the GOA unit set and the GOA trace set are respectively disposed in the pixel units that are in two adjacent rows, and the GOA trace set is electrically connected to two ends of the GOA unit set through a plurality of first signal connecting traces, the GOA circuit disposed along an extending direction of a long edge of the gate-driver-on-array type display panel.

2. The gate-driver-on-array type display panel according to claim 1, wherein the GOA unit set comprises a plurality of cascaded GOA units.

3. The gate-driver-on-array type display panel according to claim 2, wherein each one of the GOA units comprises a plurality of thin film transistors and a plurality of first internal connecting traces, and each of the first internal connecting traces is electrically connected to the respective thin film transistor.

4. The gate-driver-on-array type display panel according to claim 3, further comprising a plurality of scan lines and a plurality of data lines, wherein the scan lines are electrically connected to the thin film transistors, and an arrangement direction of the data lines is perpendicular to an arrangement direction of the scan lines.

5. The gate-driver-on-array type display panel according to claim 4, wherein a side of each one of the data lines is correspondingly provided with one of the first signal connecting traces, and an arrangement direction of the first signal connecting traces is parallel to the arrangement direction of the data lines.

6. The gate-driver-on-array type display panel according to claim 4, wherein the first internal connecting trace goes across the data line and electrically connects the GOA unit set and the first signal connecting trace.

7. The gate-driver-on-array type display panel according to claim 4, wherein the scan lines and the first internal connecting traces are formed in a first metal layer, and the data lines and the first signal connecting traces are formed in a second metal layer.

8. The gate-driver-on-array type display panel according to claim 7, wherein the material of the first metal layer is any one of Ti, Mo, Ta, W, and Nb, and the material of the second metal layer is any one of Cu, Al, Ag, and Au.

9. The gate-driver-on-array type display panel according to claim 1, wherein the GOA trace set comprises a GOA bus line and a common line.

10. A gate-driver-on-array type display panel having a display area, comprising:

a plurality of pixel units disposed in an array in the display area; and a GOA circuit disposed in the display area;

wherein the GOA circuit comprises a GOA unit set and a GOA trace set, the GOA unit set and the GOA trace set are respectively disposed in the pixel units that are in two adjacent rows, and the GOA trace set is electrically connected to two ends of the GOA unit set through a plurality of first signal connecting traces.

11. The gate-driver-on-array type display panel according to claim 10, wherein the GOA unit set comprises a plurality of cascaded GOA units.

12. The gate-driver-on-array type display panel according to claim 11, wherein each one of the GOA units comprises a plurality of thin film transistors and a plurality of first internal connecting traces, and the first internal connecting trace is electrically connected to the respective thin film transistor.

13. The gate-driver-on-array type display panel according to claim 12, further comprising a plurality of scan lines and a plurality of data lines, wherein the scan lines are electrically connected to the thin film transistors, and an arrangement direction of the data lines is perpendicular to an arrangement direction of the scan lines.

14. The gate-driver-on-array type display panel according to claim 13, wherein a side of each one of the data lines is correspondingly provided with one of the first signal connecting traces, and an arrangement direction of the first signal connecting traces is parallel to the arrangement direction of the data lines.

15. The gate-driver-on-array type display panel according to claim 13, wherein the first internal connecting trace goes across the data line and electrically connects the GOA unit set and the first signal connecting trace.

16. The gate-driver-on-array type display panel according to claim 13, wherein the scan lines and the first internal connecting traces are provided in a first metal layer, and the data lines and the first signal connecting traces are provided in a second metal layer.

17. The gate-driver-on-array type display panel according to claim 16, wherein the material of the first metal layer is any one of Ti, Mo, Ta, W and Nb, and the material of the second metal layer is any one of Cu, Al, Ag, and Au.

18. The gate-driver-on-array type display panel according to claim 10, wherein the GOA trace set comprises a GOA bus line and a common line.

* * * * *